US012678685B2

(12) United States Patent
Yu

(10) Patent No.: US 12,678,685 B2
(45) Date of Patent: Jul. 14, 2026

(54) SOCCER DRILL TABLE FOR PHYSICAL EDUCATION

(71) Applicant: Shandong Normal University, Jinan (CN)

(72) Inventor: Yue Yu, Jinan (CN)

(73) Assignee: Shandong Normal University, Jinan (CN)

( * ) Notice: Subject to any disclaimer, the term of this patent is extended or adjusted under 35 U.S.C. 154(b) by 200 days.

(21) Appl. No.: 18/810,440

(22) Filed: Aug. 20, 2024

(65) Prior Publication Data

US 2026/0054158 A1 Feb. 26, 2026

(51) Int. Cl.
*A63F 7/06* (2006.01)
*A63F 7/30* (2006.01)

(52) U.S. Cl.
CPC ..... *A63F 7/0672* (2013.01); *A63F 7/30* (2013.01); *A63F 2007/3025* (2013.01)

(58) Field of Classification Search
CPC ... A63F 7/0672; A63F 7/30; A63F 2007/3025
USPC ..... 273/317.1, 317.5
See application file for complete search history.

(56) References Cited

U.S. PATENT DOCUMENTS 2,832,596 A * 4/1958 Brown ..... A63F 7/0672 273/108.52
4,060,245 A * 11/1977 Gamez Duch ..... A63F 7/0668 273/108.5
5,423,537 A * 6/1995 Santana ..... A63F 7/0668 273/129 R
5,431,397 A * 7/1995 Eckel ..... A63F 7/0668 273/284
10,843,064 B1 * 11/2020 Rivera ..... A63F 3/00041
11,638,867 B2 * 5/2023 Witherill ..... A63F 7/0616 273/317.1
2016/0107077 A1 * 4/2016 Kuroiwa ..... A63F 7/0023 273/108.56
2023/0191238 A1 * 6/2023 Abdu ..... B67B 7/16 273/317.1

* cited by examiner

*Primary Examiner* — Luan K Bui

(57) ABSTRACT

The present disclosure belongs to the technical field of sports equipment, and in particular relates to a soccer drill table for physical education. In response to the problem that soccer sport cannot be depicted and drilled vividly when soccer teaching is performed via a soccer drill table, formal and clear boundary lines are arranged, allowing a lecturer to explain to students more easily, and helping the students to comprehend rules of a soccer field more clearly and visually; and the delineation of the boundary lines enables the students to better comprehend tactics on the soccer field, helps students know how to better collaborate and cooperate in different areas, and provides the students with clear and definite training objectives.

10 Claims, 6 Drawing Sheets

SOCCER DRILL TABLE FOR PHYSICAL EDUCATION

TECHNICAL FIELD

The present disclosure relates to the technical field of sports equipment, and in particular to a soccer drill table for physical education.

BACKGROUND

Soccer game, as a popular full-body sport worldwide, can enhance the cardiopulmonary function and improve the oxygen intake, thereby strengthening the physical fitness and the resistance. The rapid actions involving passing, catching and shooting in the soccer game can exercise the reaction speed and agility, so that players can better cope with emergencies in their lives. Playing soccer is an effective way to relieve stress, which helps to release pressure and make one more efficient and energetic in work and study. Playing soccer can also exercise visual tracking ability and improve eye focus, which helps to prevent myopia and other eyesight problems. The successful offense and defense in the soccer game invest players with a sense of accomplishment and self-confidence, and this positive attitude can act on players' daily life. In the soccer game, players can make new friends and expand their social circles, making life move enjoyable and enriching. Soccer is a collective sport, and a standard soccer game involves two teams of 10 players each with a goalkeeper, a total of 22 players, playing against, defending and offending each other on a rectangular grass field, which requires both tacit understanding and cooperation among the players in one team. To visualize soccer teaching to students, soccer drill tables have become physical education equipment common for soccer teaching.

Currently, soccer sport cannot be depicted and drilled vividly when soccer teaching is performed via soccer drill tables available on the market, with a poor demonstration and teaching effect on the students, which is unable to keep the students up to date on soccer offensive and defensive strategies.

SUMMARY

In response to the technical problem that soccer sport cannot be depicted and drilled vividly when soccer teaching is performed via conventional soccer drill tables, the present disclosure provides a soccer drill table for physical education.

A soccer drill table for physical education provided by the present disclosure includes a table board. Enclosure boards are mounted around the table board, and progress sliding holes are disposed on positions, close to top ends, of the enclosure boards located at a front end and a rear end; a simulation mechanism is mounted on the progress sliding holes, and the simulation mechanism includes an inner sliding rod; boundary lines are drew on an upper surface of the table board, and the boundary lines include scaled-down side lines, restricted area lines, goal lines, a center line, a kick-off circle line and penalty area lines of a regular soccer field; and miniature goals are disposed on opposite sides of the enclosure boards located on two sides, and ball boxes are arranged on outer sides of the enclosure boards disposed with the miniature goals.

Preferably, a mounting hole is disposed at one end, away from the enclosure board, of each of the ball boxes, and an inner wall of the mounting hole is slidably connected to a movable rod; a retaining plate I is sleeved on a position, close to a middle, of a circumferential outer wall of the movable rod, a retaining plate II is fixed to one end, close to the enclosure board, of the movable rod via a bolt, and positions, close to circumferential edges, of opposite sides of the retaining plate I and the retaining plate II are connected to a same support spring; and one side, away from the enclosure board, of the circumferential outer wall of the movable rod is threadedly connected to a threaded pipe, an insertion hole is disposed on a circumferential outer wall of the threaded pipe in a penetration manner, and an inner wall of the insertion hole is inserted with a pulling rod.

Preferably, the simulation mechanism includes the inner sliding rod, a limit plate II is sleeved on a position, close to one end, of a circumferential outer wall of the inner sliding rod, a limit plate I is sleeved on a position, close to the limit plate I, of the circumferential outer wall of the inner sliding rod, and a gap between the limit plate I and the limit plate II is slidably connected to the enclosure board.

Preferably, an outer sliding pipe is sleeved at one end, away from the limit plate I, of the circumferential outer wall of the inner sliding rod, and an abutting plate is sleeved on and fixed to a circumferential outer wall of one end, close to the limit plate I, of the outer sliding pipe; loading blocks are evenly sleeved on and fixed to positions, close to a middle, of the circumferential outer wall of the outer sliding pipe, and opposite sides of two adjacent loading blocks are connected to a same reset spring; and one end, away from the limit plate I, of the outer sliding pipe passes through the enclosure board, and a handle is sleeved on and fixed to a circumferential outer wall of the end, away from the limit plate I, of the outer sliding pipe.

Preferably, a sliding groove is disposed on one side of each of the loading blocks, and the sliding groove is slidably connected to a sliding block; and one side, away from the loading block, of the sliding block is clamped with a loading rod, and clamping grooves are disposed at a top end and a bottom end of the loading rod; a clamping block is clamped to the clamping groove at the top end of the loading rod, and a head board is welded to one side, away from the loading block, of the clamping block; a clamping block is clamped to the clamping groove at the bottom end of the loading rod, and a buffer pipe is welded to one side, away from the loading block, of the clamping block; a buffer spring is mounted at a bottom of the buffer pipe, and a foot board is welded to one end, away from the loading block, of the buffer spring; and parts of the loading blocks are connected to simulated players via the sliding blocks.

Preferably, shaft holes are disposed on positions, close to sides of top ends, of opposite sides of the enclosure boards disposed with the progress sliding holes, and two shaft holes are inserted with a same winding shaft; the winding shaft is connected to a winding net via a coil spring, and a clamping rod is clamped to one end, away from the winding shaft, of the winding net; and hooks are sleeved on a circumferential outer wall of the clamping rod, and a hanging groove is disposed at a top end of the enclosure board on the side away from the clamping rod.

Preferably, evenly distributed obstacle holes are disposed on a position, close to one side, of the upper surface of the table board.

Preferably, the obstacle holes are inserted with obstacle posts, hinges are fixed to top ends of the obstacle posts via bolts, and obstacle boards are fixed to the other ends of the hinges.

Preferably, connecting blocks I are fixed to positions, close to four corners, of a bottom end of the table board via bolts, and two sides of each of the connecting blocks I are disposed with circular holes; and the circular holes are inserted with a same limit shaft, a circumferential outer wall of the limit shaft is rotatably connected to a U-shaped block, and a table leg is welded to a bottom end of the U-shaped block.

Preferably, a connecting block II is fixed to a bottom end of the table leg via a bolt, shaft holes are disposed on two sides of the connecting block II, the shaft holes are inserted and fixed with a same wheel shaft, and a circumferential outer wall of the wheel shaft is rotatably connected to a rolling wheel.

The present disclosure has the following advantageous effects.

1. The formal and clear boundary lines are arranged, allowing a lecturer to explain to students more easily, and helping the students to comprehend rules of a soccer field more clearly and visually. The delineation of the boundary lines enables the students to better comprehend tactics and strategies on the soccer field, helps the students know how to better collaborate and cooperate in different areas, and provides the students with clear and definite training objectives.
2. By arranging the movable rod and the support spring, the serve can be simulated. By simulating serving, the students can practice and improve their serving skills in a safe environment and reduce the risks caused by serving errors in official games. By practicing on the drill table, the students can gradually master the correct serving skills and play more confidently in actual games, and practicing serving on the drill table helps the students to better understand running positions and tactical arrangements of their teammates, so that they can cooperate more tacitly in actual games.
3. By arranging the simulated players, the students can better comprehend the tactics and strategies used in soccer games and learn how to make the right decisions in different situations. The simulated players can also provide the students with a variety of technical challenges, such as passing, shooting, ball controlling and defending. The students can continuously improve their technical skills through interaction with the simulated players, play their skills more confidently in games and adapt better to the pace and intensity of the games, thus performing better in official games.
4. By arranging the obstacle boards, it can simulate various situations in real games, such as defensive and offensive tactics, and ball controlling and passing skills, providing the students with a more realistic training environment, and also can increase the difficulty and challenge of training, stimulating students' fighting spirit and potential, and improving their training effect and competitive level. The obstacle boards can also be used for various specific training, such as practicing around piles, shooting and passing, so that the students can improve their skill level in more professional training.
5. By arranging the limit shaft, the table leg can be changed in direction and is folded to reduce the space for storing the drill table, and cooperated with the rolling wheel, the drill table can be rapidly and easily moved to adapt to different places and environments, such as indoor, outdoor, grass, and hard ground, to meet the different training needs and game scenes, avoiding accidental injuries caused by the fixed drill table, and the movable drill table can be repeatedly used for a long time.

Figure 1:
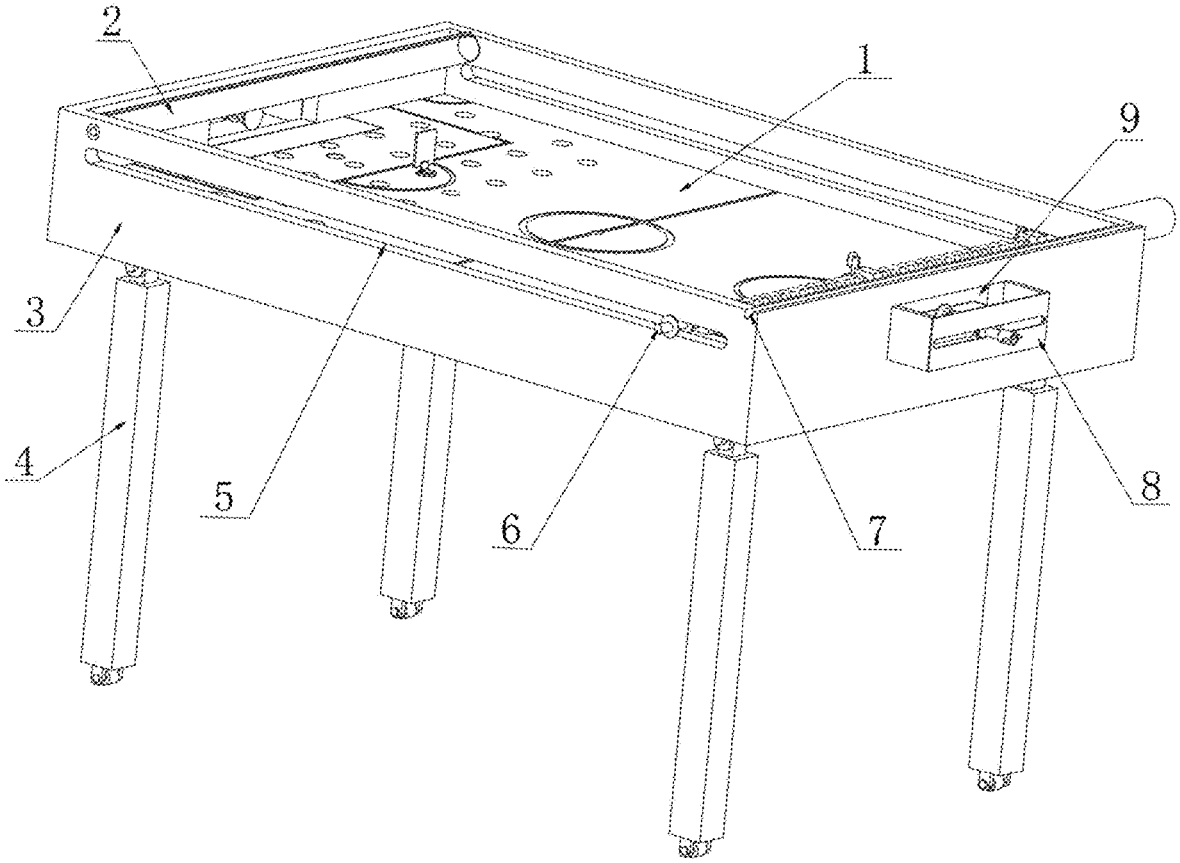
FIG. 1 is a schematic diagram of an overall structure of a soccer drill table for physical education according to the present disclosure.

Reference numerals and denotations thereof. 1—table board; 2—winding net; 3—enclosure board; 4—table leg; 5—progress sliding hole; 6—inner sliding rod; 7—hanging groove; 8—ball box; 9—miniature goal; 10—boundary line; 11—obstacle board; 12—threaded pipe; 13—obstacle hole; 14—foot board 15—loading block; 16—handle; 17—pulling rod; 18—retaining plate I; 19—movable rod; 20—retaining plate II; 21—support spring; 22—obstacle post; 23—hinge; 24—simulated player; 25—abutting plate; 26—limit plate I; 27—limit plate II; 28—outer sliding pipe; 29—head board; 30—reset spring; 31—winding shaft; 32—clamping rod; 33—hook; 34—limit shaft; 35—connecting block I; 36—U-shaped block; 37—connecting block II; 38—wheel shaft; 39—rolling wheel; 40—clamping block; 41—sliding block; 42—loading rod; 43—buffer pipe; and 44—buffer spring.

DETAILED DESCRIPTION

The technical solutions of the examples in the present disclosure will be described clearly and completely by reference to the accompanying drawings of the examples in the present disclosure below. Obviously, the examples described are only some, rather than all examples of the present disclosure.

Example 1: referring to FIGS. 1-8, a soccer drill table for physical education includes a table board 1. Enclosure boards 3 are mounted around the table board 1, and progress sliding holes 5 are disposed on positions, close to top ends, of the enclosure boards 3 located at a front end and a rear end. A simulation mechanism is mounted on the progress sliding holes 5, and the simulation mechanism includes an inner sliding rod 6. Boundary lines 10 are drew on an upper surface of the table board 1, and the boundary lines 10 include scaled-down side lines, goal lines, a center line, a kick-off circle line and penalty area lines of a regular soccer field. The side lines are two longer edge lines, defining a length of a soccer field. The goal lines, commonly known as baselines, are the shorter sides of the soccer field, marking whether a soccer is in the goal. A line in the middle of the soccer field parallel to the goal lines is the center line, dividing the soccer field into two half-courts. A circle, drew by taking a distinct mark made in the center of the playing field as a center and a fixed distance as a radius, is known as the kick-off circle. An area in front of the goal line and between the two long lines is the penalty area. Miniature goals 9 are disposed on opposite sides of the enclosure boards 3 located on two sides, and ball boxes 8 are arranged on outer sides of the enclosure boards 3 disposed with the miniature goals 9. The ball boxes 8 serve as ball nets, making the drill table closer to a real soccer field, and the ball boxes 8 are convenient for a user to take a miniature soccer ball at any time. The formal and clear boundary lines 10 are arranged, allowing a lecturer to explain to students more easily, and helping the students to comprehend rules of the soccer field more clearly and visually. The delineation of the boundary lines 10 enables the students to better comprehend tactics and strategies on the soccer field, helps the students know how to better collaborate and cooperate in different areas, and provides the students with clear and definite training objectives.

Figure 2:
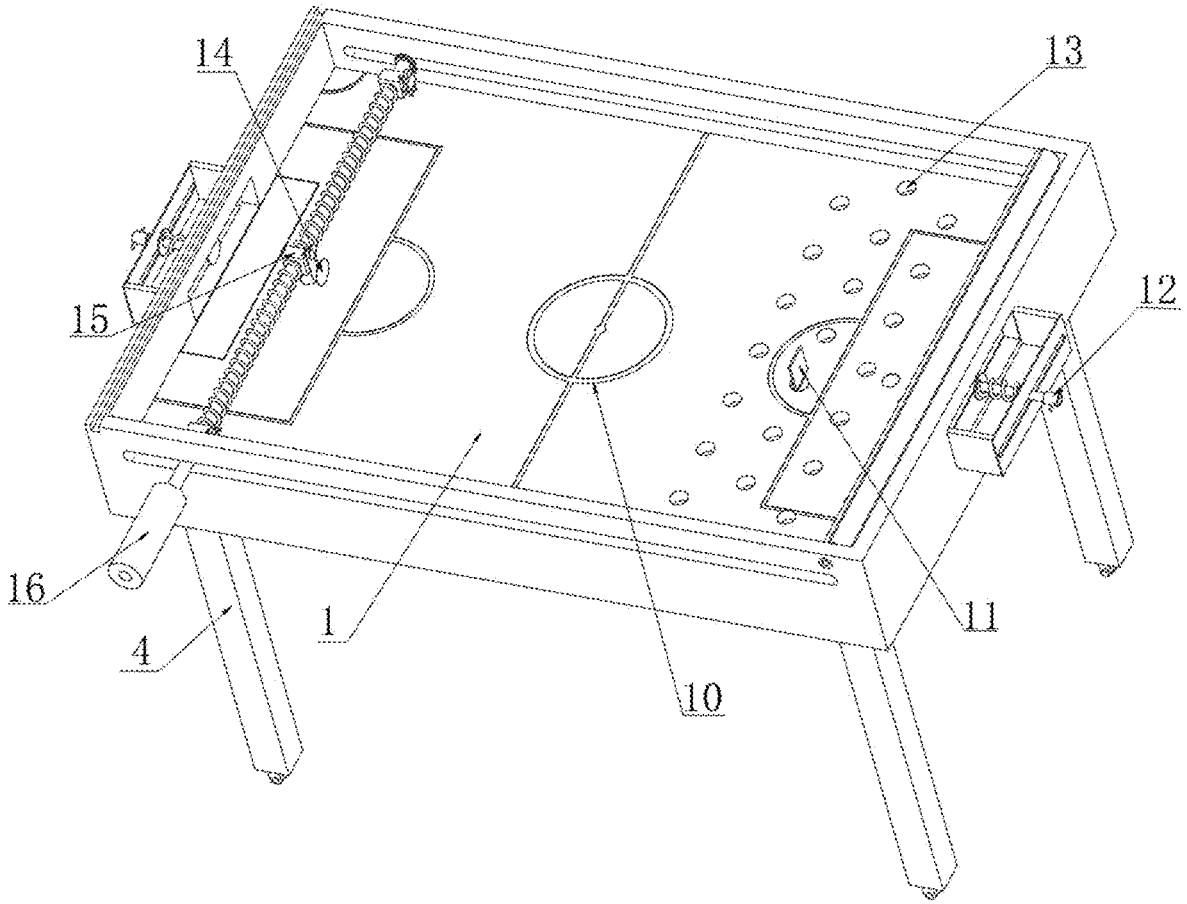
FIG. 2 is a schematic structural diagram of a top end of the soccer drill table for physical education according to the present disclosure.
Figure 3:
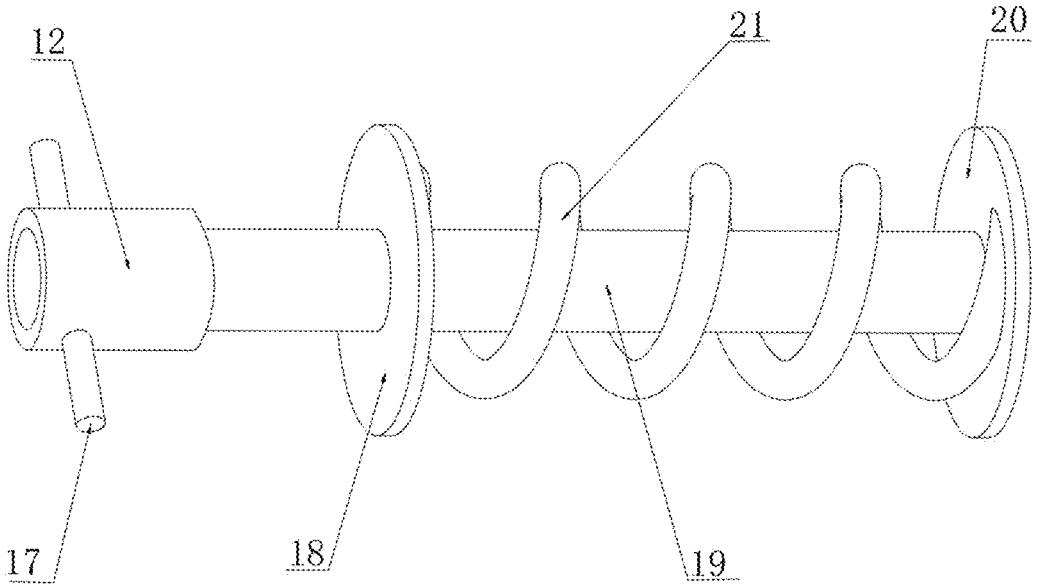
FIG. 3 is a schematic diagram of a movable rod mechanism of the soccer drill table for physical education according to the present disclosure.

Referring to FIGS. 2 and 3, a mounting hole is disposed at one end, away from the enclosure boards 3, of each of the ball boxes 8, and an inner wall of the mounting hole is slidably connected to a movable rod 19. A retaining plate I 18 is sleeved on a position, close to a middle, of a circumferential outer wall of the movable rod 19, a retaining plate II 20 is fixed to one end, close to the enclosure board 3, of the movable rod 19 via a bolt, and positions, close to circumferential edges, of opposite sides of the retaining plate I 18 and the retaining plate II 20 are connected to a same support spring 21. One side, away from the enclosure board 3, of the circumferential outer wall of the movable rod 19 is threadedly connected to a threaded pipe 12, an insertion hole is disposed on a circumferential outer wall of the threaded pipe 12 in a penetration manner, and an inner wall of the insertion hole is inserted with a pulling rod 21. By arranging the movable rod 19 and the support spring 21, the serve can be simulated. By simulating serving, the students can practice and improve their serving skills in a safe environment and reduce the risks caused by serving errors in official games. By practicing on the drill table, the students can gradually master the correct serving skills and play more confidently in actual games, and practicing serving on the drill table can help the students to better understand running positions and tactical arrangements of their teammates, so that they can cooperate more tacitly in actual games.

Figure 5:
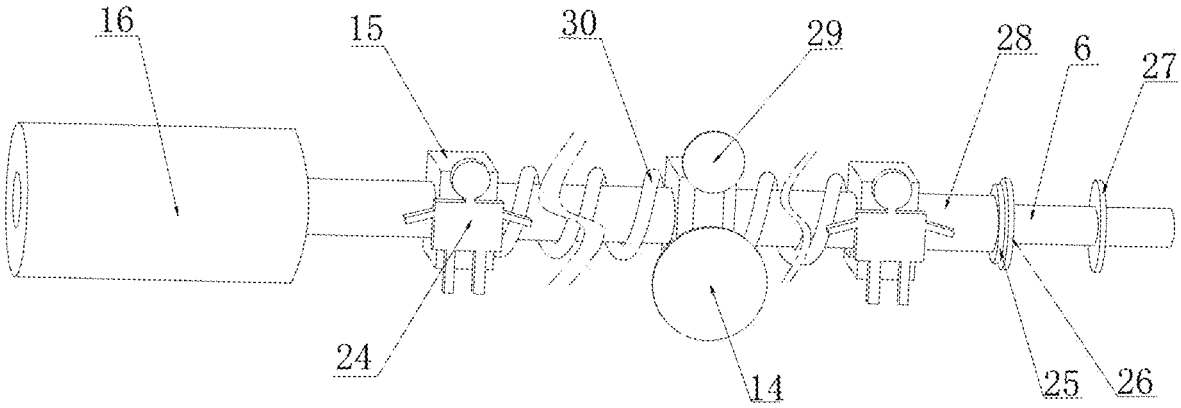
FIG. 5 is a schematic diagram of a simulation mechanism of the soccer drill table for physical education according to the present disclosure.

Referring to FIG. 5, the simulation mechanism includes the inner sliding rod 6, a limit plate II 27 is sleeved on a position, close to one end, of a circumferential outer wall of the inner sliding rod 6, a limit plate I 26 is sleeved on a position, close to the limit plate II 27, of the circumferential outer wall of the inner sliding rod 6, and a gap between the limit plate I 26 and the limit plate II 27 is slidably connected to the enclosure board 3. By means of the limit plate I 26 and the limit plate II 27, the inner sliding rod 6 is fixed in the progress sliding hole 5 of the enclosure board 3, preventing the inner sliding rod 6 from falling off when subjected to a force.

Referring to FIG. 5, an outer sliding pipe 28 is sleeved on one end, away from the limit plate I 26, of the circumferential outer wall of the inner sliding rod 6, and an abutting plate 25 is sleeved on and fixed to a circumferential outer wall of one end, close to the limit plate I 26, of the outer sliding pipe 28. The abutting plate 25 limits the range of movement of loading block 15, preventing the loading block 15 from sliding into the inner sliding rod 6 under the action of the reset spring 30. Loading blocks 15 are evenly sleeved on and fixed to positions, close to a middle, of the circumferential outer wall of the outer sliding pipe 28, and opposite sides of two adjacent loading blocks 15 are connected to a same reset spring 30. The reset spring 30 keeps each loading block 15 at the same distance. One end, away from the limit plate I 26, of the outer sliding pipe 28 passes through the enclosure board 3, and a handle 16 is sleeved on and fixed to a circumferential outer wall of the end, away from the limit plate I 26, of the outer sliding pipe 28. By arranging the handle 16, the outer sliding pipe 28 can be moved more easily, the force direction of the outer sliding pipe 28 and the inner sliding rod 6 can be changed, and the direction of the loading block 15 can be changed, so as to make the environment closer to a real field environment.

Figure 8:
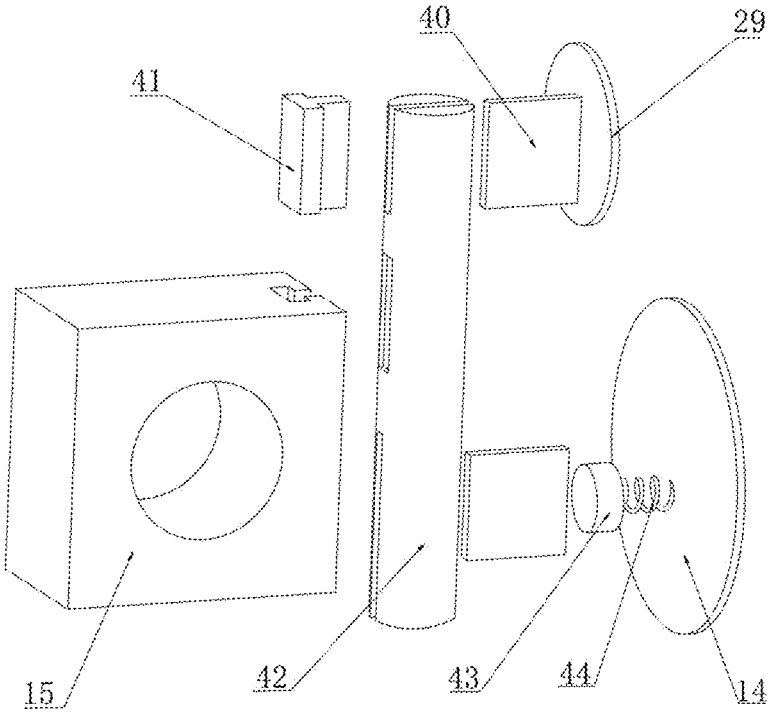
FIG. 8 is a schematic structural diagram of a loading block of the soccer drill table for physical education according to the present disclosure.

Referring to FIG. 8, a sliding groove is disposed on one side of each of the loading blocks 15, and the sliding groove is slidably connected to a sliding block 41. One side, away from the loading block 15, of the sliding block 41 is clamped with a loading rod 42, and clamping grooves are disposed at a top end and a bottom end of the loading rod 42. A clamping block 40 is clamped to the clamping groove at the top end of the loading rod 42, and a head board 29 is welded to one side, away from the loading block 15, of the clamping block 40. The head board 29, equivalent to a real person's head, serves to pass, making the drill table more realistic. A clamping block 40 is clamped to the clamping groove at the bottom end of the loading rod 42, and a buffer pipe 43 is welded to one side, away from the loading block 15, of the clamping block 40. A buffer spring 44 is mounted at a bottom of the buffer pipe 43, and a foot board 14 is welded to one end, away from the loading block 15, of the buffer spring 44. The foot board 14, equivalent to a real person's foot, serves to pass, and the buffer spring 44 can simulate a ball-stopping operation by a real person's foot. Parts of the loading blocks 15 are connected to simulated players 24 via the sliding blocks 41. By arranging the simulated players 24, the students can better comprehend the tactics and strategies applied in soccer games and learn how to make the right decisions in different situations. The simulated players 24 can also provide the students with various technical challenges, such as passing, shooting, ball controlling and defensing, and the students can continuously improve their technical skills by interacting with the simulated players 24, and play their skills more confidently and adapt better to the pace and intensity of the games, thus performing better in official games.

Figure 6:
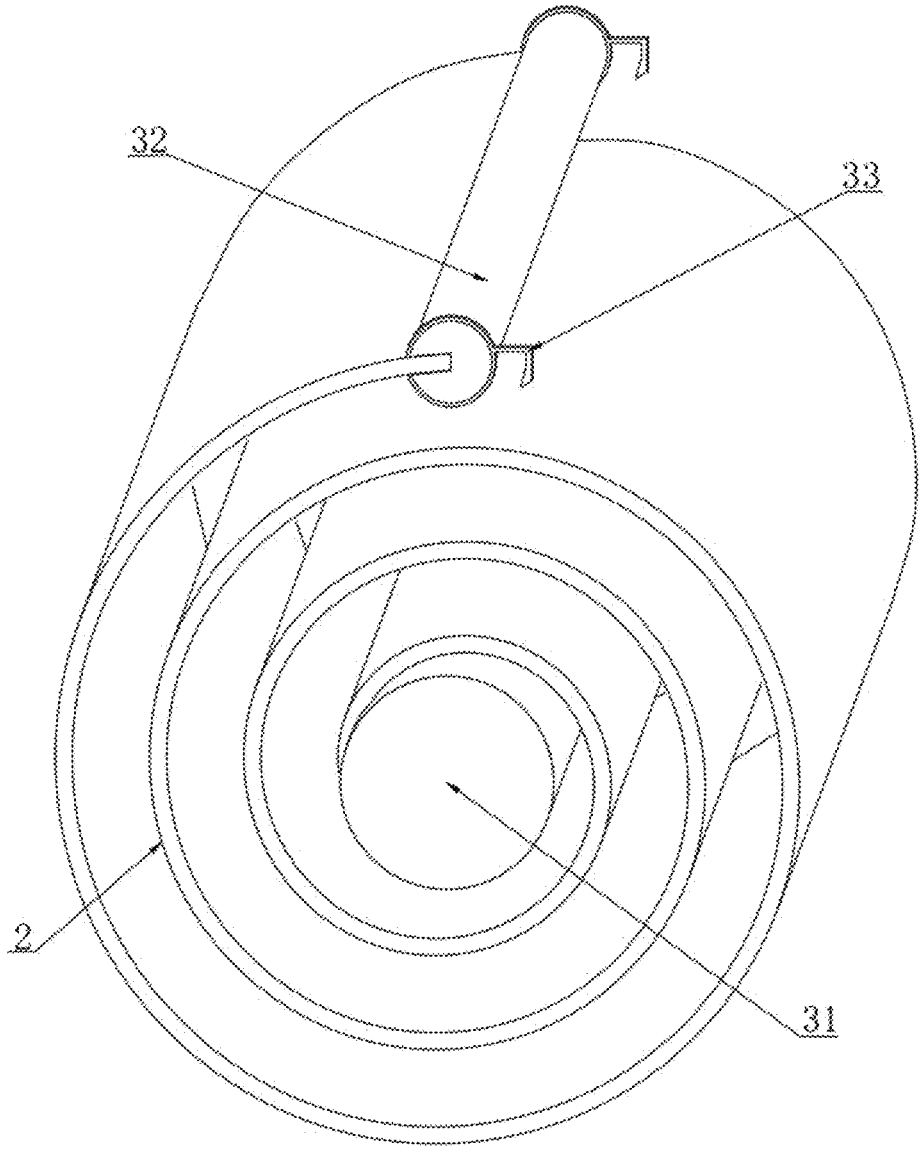
FIG. 6 is a schematic structural diagram of a winding net of the soccer drill table for physical education according to the present disclosure.

Referring to FIG. 6, shaft holes are disposed on positions, close to sides of top ends, of opposite sides of the enclosure boards 3 disposed with the progress sliding holes 5, and two shaft holes are inserted with a same winding shaft 31. The winding shaft 31 is connected to a winding net 2 via a coil spring, and a clamping rod 32 is clamped to one end, away from the winding shaft 31, of the winding net 2. Hooks 33 are sleeved on a circumferential outer wall of the clamping rod 32, and a hanging groove 2 is disposed at a top end of the enclosure board 3 on the side away from the clamping rod 32. By arranging the winding net 2, when the drill table is in use, the winding net 2 can prevent a miniature soccer ball from flying out of the drill table due to violent collision, to avoid loss or damage; and when the drill table is not in use, the winding net 2 can prevent dust to prolong the service life of the drill table.

Figure 4:
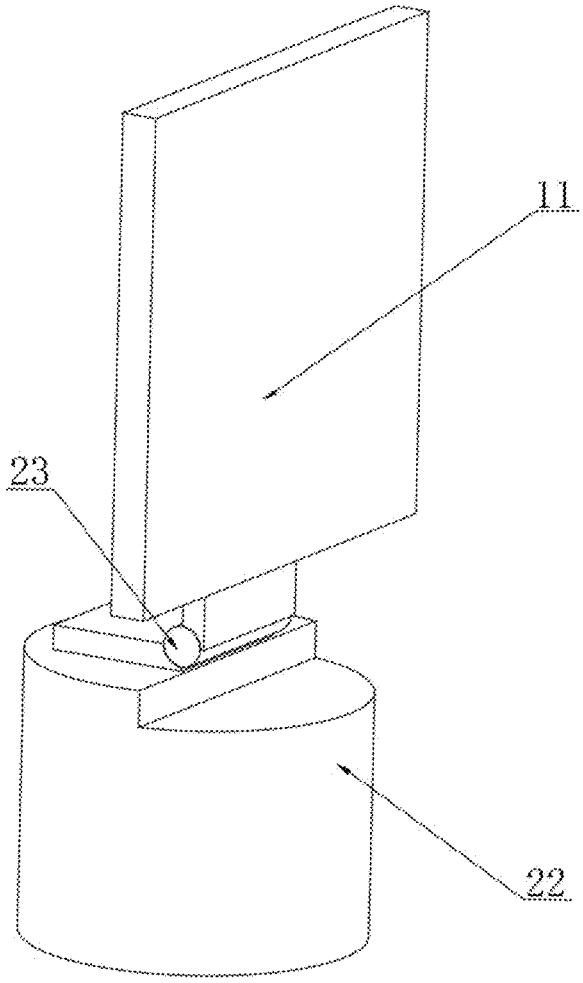
FIG. 4 is a schematic diagram of an obstacle mechanism of the soccer drill table for physical education according to the present disclosure.

Referring to FIGS. 2 and 4, evenly distributed obstacle holes 13 are disposed on a position, close to one side, of the upper surface of the table board 1. The obstacle holes 13 are inserted with obstacle posts 22, hinges 23 are fixed to top ends of the obstacle posts 22 via bolts, and obstacle boards 11 are fixed to the other ends of the hinges 23. By arranging the obstacle boards 11, it can simulate various situations in real games, such as defensive and offensive tactics, and ball controlling and passing skills, which provides the students with a more realistic training environment, and also increases the difficulty and challenge of training, stimulating students' fighting spirit and potential, and improving their training effect and competitive level. The obstacle boards 11 can also be used for various specific training, such as practicing around piles, shooting and passing, so that the students can improve their skill level in more professional training.

Figure 7:
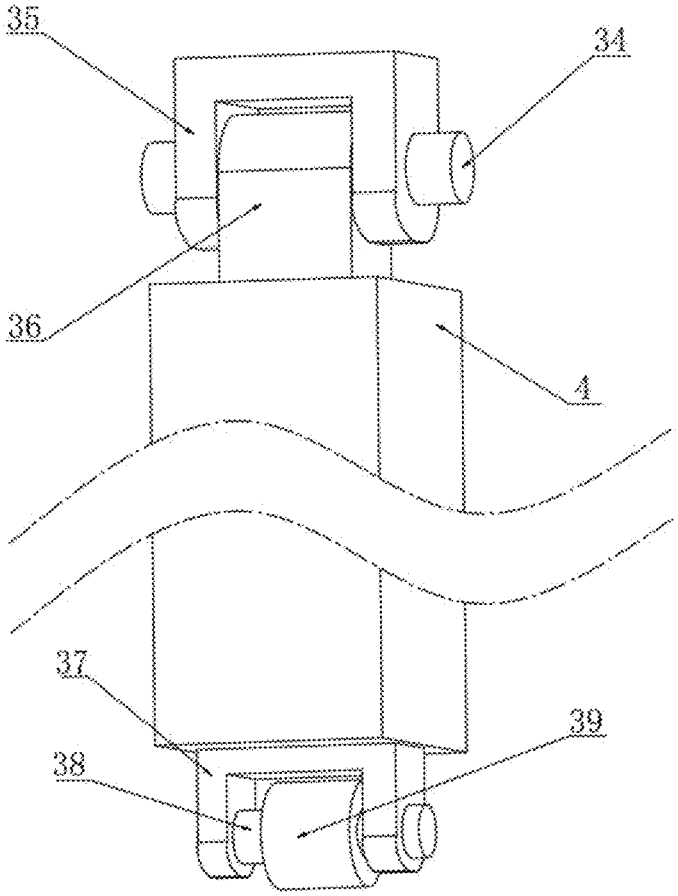
FIG. 7 is a schematic structural diagram of a table leg of the soccer drill table for physical education according to the present disclosure.

Example 2: a soccer drill table for physical education is provided, and the following improvements are made in this example on the basis of Example 1, as shown in FIGS. 1 and 7.

Connecting blocks I 35 are fixed to positions, close to four corners, of a bottom end of the table board 1 via bolts, and two sides of each of the connecting blocks I 35 are disposed with circular holes. The circular holes are inserted with a same limit shaft 34, a circumferential outer wall of the limit shaft 34 is rotatably connected to a U-shaped block 36, and a table leg 4 is welded to a bottom end of the U-shaped block 36. By means of the limit shaft 34, the table leg 4 can be changed in direction and is folded. A connecting block II 37 is fixed to a bottom end of the table leg 4 via a bolt, and shaft holes are disposed on two sides of the connecting block II 37. The shaft holes are inserted and fixed with a same wheel shaft 38, and a circumferential outer wall of the wheel shaft 38 is rotatably connected to a rolling wheel 39. By means of the limit shaft 34, the table leg 4 can be changed in direction and is folded to reduce the space for storing the drill table, and cooperated with the rolling wheel 39, the drill table can be easily and rapidly moved to adapt to different places and environments, such as indoor, outdoor, grass, and hard ground, to meet the different training needs and game scenes, avoiding accidental injuries caused by the fixed drill table, and the movable drill table can be repeatedly used for a long time.

When in use, by means of the rolling wheel 39, the drill table is moved to a drill place rapidly and easily; by dragging the pulling rod 17, the support spring 21 is compressed, so that the retaining plate II 20 is moved outward; by releasing the pulling rod 17, the support spring 21 releases force and is elongated to push the retaining plate II 20, which collides with a miniature soccer ball to simulate the launching of the soccer ball; the obstacle boards 11 are arranged to simulate defense players to intercept the moving miniature soccer ball; the head board 29 and the foot board 14 are used to collide with the miniature soccer ball, simulating the effect of striking by a real head and foot; by pulling the handle 16 outward, the outer sliding pipe 28 slides away from the inner sliding rod 6 to compress the reset spring 30, so that the spacing between various loading blocks 15 becomes smaller, thereby simulating a defensive lineup, and the defensive posture is adjusted by observing the simulated players 24; when the drill is in progress, the hooks 33 are pulled and fixed to the hanging groove 7, allowing the winding net 2 to cover the space above the table board 1; and when the drill table is not in use, the limit shaft 34 is adjusted, so that the table leg 4 is folded transversely to reduce the occupied space.

The above mentioned are only better embodiments of the present disclosure, rather than the limitation on the present disclosure. Within the technical scope disclosed by the present disclosure, any equivalent replacements or variations made by any skilled familiar with the technical field according to the technical solutions of the present disclosure and inventive concepts thereof shall be covered by the scope of protection of the present disclosure.

The invention claimed is:

1. A soccer drill table for physical education, comprising a table board (1), wherein enclosure boards (3) are mounted around the table board (1), and progress sliding holes (5) are disposed on positions, close to top ends, of the enclosure boards (3) located at a front end and a rear end; a simulation mechanism is mounted on the progress sliding holes (5), and the simulation mechanism comprises an inner sliding rod (6); boundary lines (10) are drew on an upper surface of the table board (1), and the boundary lines (10) comprise scaled-down side lines, restricted area lines, goal lines, a center line, a kick-off circle line and penalty area lines of a regular soccer field; and miniature goals (9) are disposed on opposite sides of the enclosure boards (3) located on two sides, and ball boxes (8) are arranged on outer sides of the enclosure boards (3) disposed with the miniature goals (9).

2. The soccer drill table for physical education according to claim 1, wherein a mounting hole is disposed at one end, away from the enclosure board (3), of each of the ball boxes (8), and an inner wall of the mounting hole is slidably connected to a movable rod (19); a retaining plate I (18) is sleeved on a position, close to a middle, of a circumferential outer wall of the movable rod (19), a retaining plate II (20) is fixed to one end, close to the enclosure board (3), of the movable rod (19) via a bolt, and positions, close to circumferential edges, of opposite sides of the retaining plate I (18) and the retaining plate II (20) are connected to a same support spring (21); and one side, away from the enclosure board (3), of the circumferential outer wall of the movable rod (19) is threadedly connected to a threaded pipe (12), an insertion hole is disposed on a circumferential outer wall of the threaded pipe (12) in a penetration manner, and an inner wall of the insertion hole is inserted with a pulling rod (17).

3. The soccer drill table for physical education according to claim 1, wherein the simulation mechanism comprises the inner sliding rod (6), a limit plate II (27) is sleeved on a position, close to one end, of a circumferential outer wall of the inner sliding rod (6), a limit plate I (26) is sleeved on a position, close to the limit plate II (27), of the circumferential outer wall of the inner sliding rod (6), and a gap between the limit plate I (26) and the limit plate II (27) is slidably connected to the enclosure board (3).

4. The soccer drill table for physical education according to claim 3, wherein an outer sliding pipe (28) is sleeved at one end, away from the limit plate I (26), of the circumferential outer wall of the inner sliding rod (6), and an abutting plate (25) is sleeved on and fixed to a circumferential outer wall of one end, close to the limit plate I (26), of the outer sliding pipe (28); loading blocks (15) are evenly sleeved on and fixed to positions, close to a middle, of the circumferential outer wall of the outer sliding pipe (28), and opposite sides of two adjacent loading blocks (15) are connected to a same reset spring (30); and one end, away from the limit plate I (26), of the outer sliding pipe (28) passes through the enclosure board (3), and a handle (16) is sleeved on and fixed to a circumferential outer wall of the end, away from the limit plate I (26), of the outer sliding pipe (28).

5. The soccer drill table for physical education according to claim 4, wherein a sliding groove is disposed on one side of each of the loading blocks (15), and the sliding groove is slidably connected to a sliding block (41); and one side, away from the loading block (15), of the sliding block (41) is clamped with a loading rod (42), and clamping grooves are disposed at a top end and a bottom end of the loading rod (42); a clamping block (40) is clamped to the clamping groove at the top end of the loading rod (42), and a head board (29) is welded to one side, away from the loading block (15), of the clamping block (40); a clamping block (40) is clamped to the clamping groove at the bottom end of the loading rod (42), and a buffer pipe (43) is welded to one side, away from the loading block (15), of the clamping block (40); a buffer spring (44) is mounted at a bottom of the buffer pipe (43), and a foot board (14) is welded to one end, away from the loading block (15), of the buffer spring (44); and parts of the loading blocks (15) are connected to simulated players (24) via the sliding blocks (41).

6. The soccer drill table for physical education according to claim 1, wherein shaft holes are disposed on positions, close to sides of top ends, of opposite sides of the enclosure boards (3) disposed with the progress sliding holes (5), and two shaft holes are inserted with a same winding shaft (31); the winding shaft (31) is connected to a winding net (2) via a coil spring, and a clamping rod (32) is clamped to one end, away from the winding shaft (31), of the winding net (2); and hooks (33) are sleeved on a circumferential outer wall of the clamping rod (32), and a hanging groove (7) is disposed at a top end of the enclosure board (3) on the side away from the clamping rod (32).

7. The soccer drill table for physical education according to claim 1, wherein evenly distributed obstacle holes (13) are disposed on a position, close to one side, of the upper surface of the table board (1).

8. The soccer drill table for physical education according to claim 7, wherein the obstacle holes (13) are inserted with obstacle posts (22), hinges (23) are fixed to top ends of the obstacle posts (22) via bolts, and obstacle boards (11) are fixed to the other ends of the hinges (23).

9. The soccer drill table for physical education according to claim 1, wherein connecting blocks I (35) are fixed to positions, close to four corners, of a bottom end of the table board (1) via bolts, and two sides of each of the connecting blocks I (35) are disposed with circular holes; and the circular holes are inserted with a same limit shaft (34), a circumferential outer wall of the limit shaft (34) is rotatably connected to a U-shaped block (36), and a table leg (4) is welded to a bottom end of the U-shaped block (36).

10. The soccer drill table for physical education according to claim 9, wherein a connecting block II (37) is fixed to a bottom end of the table leg (4) via a bolt, shaft holes are disposed on two sides of the connecting block II (37), the shaft holes are fixed to a same wheel shaft (38) in an insertion manner, and a circumferential outer wall of the wheel shaft (38) is rotatably connected to a rolling wheel (39).

* * * * *